US006133706A

United States Patent [19]

Quintana

[11] Patent Number: 6,133,706

[45] Date of Patent: Oct. 17, 2000

[54] PRINTER SUBSYSTEM MOTION-CONTROL SENSOR APPARATUS

[75] Inventor: Jason Quintana, Vancouver, Wash.

[73] Assignee: Hewlett-Packard Company, Palo Alto, Calif.

[21] Appl. No.: 08/819,127

[22] Filed: Mar. 17, 1997

[51] Int. Cl.[7] ..... B41J 29/42

[52] U.S. Cl. ..... 318/640; 318/564; 318/602; 318/608; 318/652; 400/705

[58] Field of Search ..... 318/564, 600, 318/601, 603, 608, 626, 640, 652, 683; 400/705

[56] References Cited

U.S. PATENT DOCUMENTS

| | | | |
|---|---|---|---|
| 3,838,250 | 9/1974 | Naas et al. . | |
| 4,208,137 | 6/1980 | Liu . | |
| 5,664,222 | 9/1997 | Inakoshi | 395/836 |

FOREIGN PATENT DOCUMENTS

| | | |
|---|---|---|
| 0900481 | 7/1962 | United Kingdom . |
| 1447878 | 9/1976 | United Kingdom . |
| 1460091 | 12/1976 | United Kingdom . |
| 1466025 | 3/1977 | United Kingdom . |
| 1495599 | 12/1977 | United Kingdom . |
| 1566281 | 4/1980 | United Kingdom . |
| 1592603 | 7/1981 | United Kingdom . |

*Primary Examiner*—Bentsu Ro

[57] ABSTRACT

In accordance with the described invention, a stepper motor that drives a printer's movable subsystem, e.g. a sled-mounted ink-jet service station, is replaced with a less expensive and quieter DC motor, and continuous positional feedback is obtained via a fixed subsystem-mounted optical sensor array in cooperation with a movable subsystem-mounted code strip that includes a home-position encoding region. The code strip produces in the optical sensor array, in reflective response to a fixed subsystem-mounted light source, a plurality of modulated signals as the substantial extent of the code strip passes by, thereby enabling positional tracking of the movable subsystem's motion, and produces a secure home-position identification signal set when the homing patch is in the 'view' of the array. The printer's controller thus can cause the DC motor to move the movable subsystem to its home position relative to a fixed subsystem without running into a hard stop, and the printer's cost is reduced without compromising positional accuracy.

9 Claims, 4 Drawing Sheets

PRINTER SUBSYSTEM MOTION-CONTROL SENSOR APPARATUS

TECHNICAL FIELD

The present invention relates generally to desk-top printers. More particularly, it concerns printer drive mechanisms and means for controlling the motion of a printer subsystem, e.g. a sled-mounted service station.

BACKGROUND ART

Conventionally, stepper motors are used to reciprocate printer subsystems such as media feed rollers, pen carriages and service stations. Stepper motors are relatively easy to control since their spindles rotate in precise, discrete steps when pulsed by an essentially digital controller. Stepper motors are so-called open-loop positional control devices requiring no feedback, as the controller simply assumes that the stepper motor has stepped the commanded number of pulses. On the other hand, stepper motors are relatively expensive and can be noisy in operation, especially during a rapid succession of abrupt starts and stops.

Conventionally, spot sensors have been used to control linear, reciprocal or rotary motion of movable printer subsystems such as printhead carriages or print media feed rollers. The former is described in U.S. Pat. No. 4,789,874 entitled SINGLE CHANNEL ENCODER SYSTEM, issued Dec. 6, 1988 and the latter is described in co-pending U.S. application Ser. No. 08/784,641, entitled MULTI-TRACK POSITION ENCODER SYSTEM, which was filed Jan. 21, 1997 under Attorney Docket Control No. 10961034-1 in the name of co-inventors Eugene Cooper and Steve Elgee, which application is commonly owned herewith. Neither suggests the use of a plural-optical sensor array and group encoding from multiple like sensors in a data correlation scheme whereby a movable printer subsystem's position and velocity may be monitored by detection of a uniquely identifiable homing patch within an otherwise regularly modulated optical coding strip.

DISCLOSURE OF THE INVENTION

Briefly, the invention may be summarized as follows. A stepper motor that drives a printer's movable subsystem, e.g. a sled-mounted ink-jet service station, is replaced with a less expensive and quieter DC motor, and continuous positional feedback is obtained via a fixed subsystem-mounted optical sensor array in cooperation with a movable subsystem-mounted code strip that includes a home-position encoding region. The code strip produces in the optical sensor array, in reflective response to a fixed subsystem-mounted light source, a plurality of modulated signals as the substantial extent of the code strip passes by, thereby enabling positional tracking of the movable subsystem's motion, and produces a secure home-position identification signal set when the homing patch is in the 'view' of the array. The printer's controller thus can cause the DC motor to move the movable subsystem to its home position without running into a hard stop, and the printer's cost is reduced without compromising positional accuracy.

These and additional objects and advantages of the present invention will be more readily understood after consideration of the drawings and the detailed description of the preferred embodiment which follows.

DETAILED DESCRIPTION OF THE PREFERRED EMBODIMENT AND BEST MODE OF CARRYING OUT THE INVENTION

Figure 1:
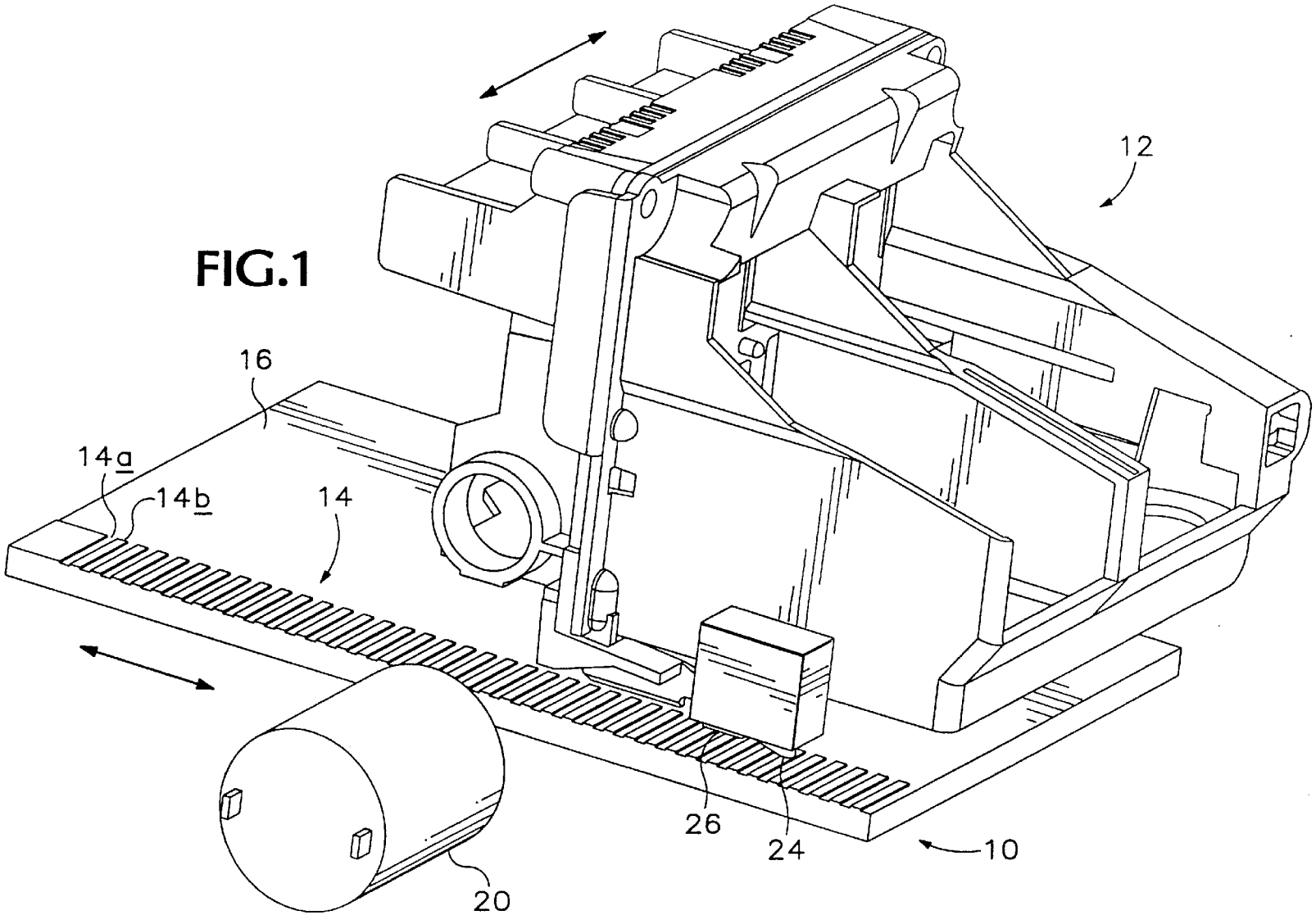
FIG. 1 is an isometric view of an ink-jet printer's service station including the invented encoding subsystem made in accordance with its preferred embodiment.
Figure 2:
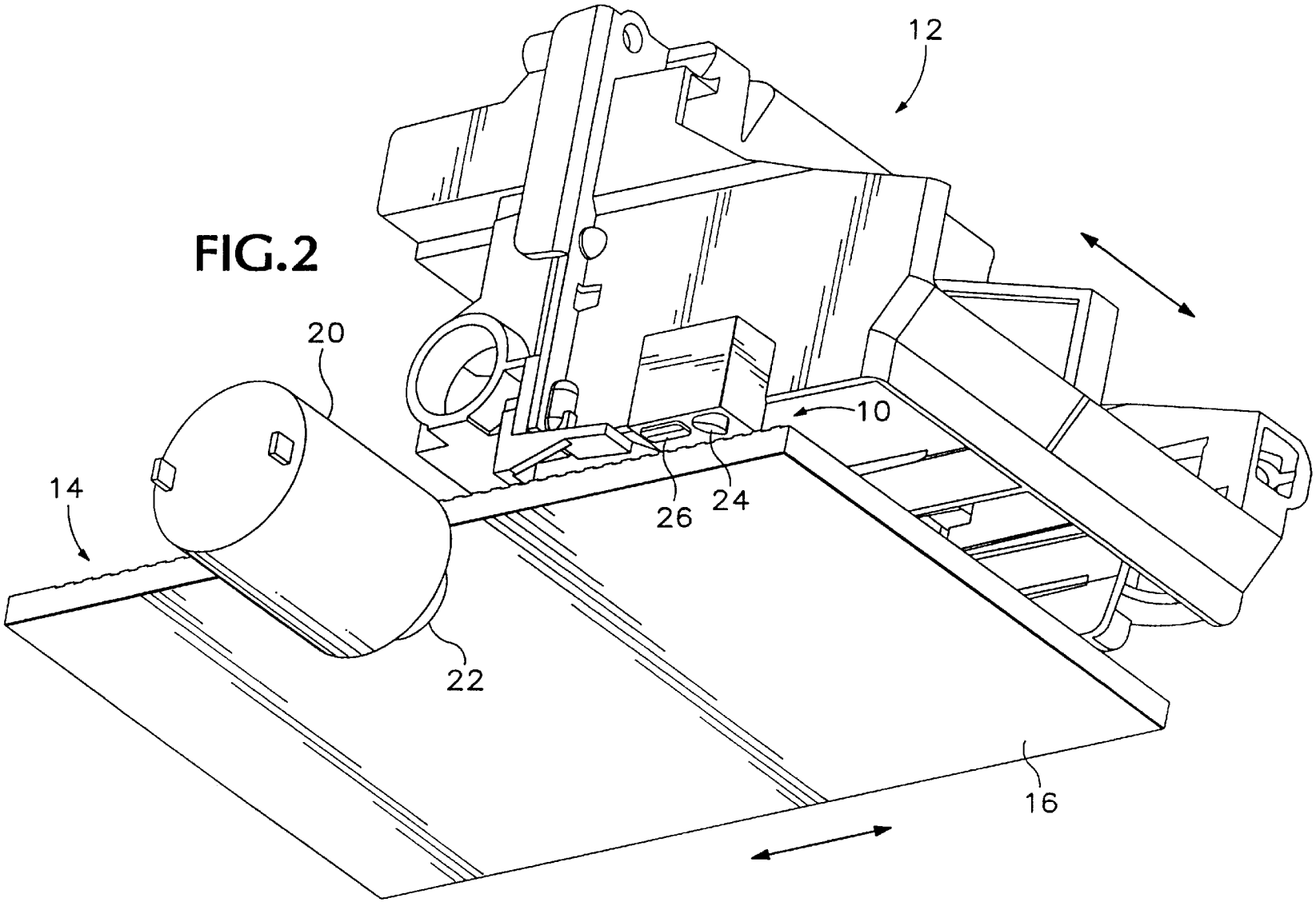
FIG. 2 is an isometric view corresponding with that of FIG. 1, but showing the service station from a different viewing angle that features a sensor array.

Referring collectively to FIGS. 1 and 2, the invented sensor is indicated generally at 10, in context with a printer subsystem, e.g. within an ink-jet printer's chassis, 12 and an encoding pattern 14 etched into a region of a printer's sled 16, represented in FIGS. 1 and 2 by a generally planar expanse, that is made to reciprocate by a reversible DC motor 20 and any suitable linkage such as a friction roller 22 (see FIG. 2).

Those of skill will appreciate that so-called fixed subsystem 12 may be a truly fixedly frame- or chassis-mounted printer subsystem, or it may be fixed only temporally in a position of alignment of its optical source and array features with the encoding pattern feature of the movable subsystem 16. Illustratively herein, fixed subsystem 12 is an ink-jet printer's pen carriage (shown without pen cartridges) that moves along an axis indicated in FIGS. 1 and 2 by a double-ended arrow that is transverse to the axis along which sled 16 moves. It will be appreciated, of course, that when invented apparatus 10 is being used to home-position sled 16 and a service station mounted thereon, carriage 12 is fixed or stationary as shown. Thus, it will be appreciated that fixed herein means at least temporarily fixed, e.g. during use of invented apparatus 10.

Those skilled in the art will appreciate that sled 16 typically would have mounted thereon a service station (not shown for the sake of clarity) including means for servicing ink-jet pens, e.g. it might include pen caps, spittoons or blotters, wiper blades, etc. Those of skill also will appreciate that DC motor 20 is driven bi-directionally by the printer's controller, e.g. a conventional, suitably programmed microprocessor (not shown in FIGS. 1 and 2, for the sake of clarity, but illustrated schematically in FIG. 5 as a controller).

It may be seen best from FIG. 2 that chassis 12 includes on its underside a light source 24 and an optical sensor array 26, both linearly aligned with pattern 14. Light source 24 may include one or more light-emitting diodes (LEDs) and sensor array 26 may include two or more, more preferably four or more and most preferably twelve or more, photosensitive diodes or transistors capable of detecting light that, incident from light source 24 on pattern 14, reflects into the field of view of optical sensor array 26. It will be understood that light sensor array 26 outputs an array of signals corresponding to changes in the luminance incident upon each sensor, as will be described below by reference to FIGS. 4 and 5. Linear, rotary or reciprocal motion of the printer subsystem, e.g. a service station mounted on movable sled 16, thus may be continuously monitored and, optionally, controlled by the printer's controller to achieve closed-loop control.

Referring still to FIGS. 1 and 2, it may be seen that encoding pattern 14 preferably is formed on an upper edge surface of sled, which is reciprocable (as indicated by double-ended arrows) relative to a fixed frame of reference, e.g. the printer's chassis, 12. Those skilled in the printer arts will appreciate that sled 16 may mount a service station including service station components not shown in the figures, for the sake of clarity. Those skilled in the printer arts also will appreciate that chassis 12 typically may be of molded plastic, as shown, and may be of relatively complex configuration. Within the spirit and scope of the invention, the fixed frame of reference represented in the preferred embodiment by chassis 12 itself may be movable, but it will still be referred to herein as a fixed frame of reference since it may be thought of as fixed relative to movable subsystem 16.

Figure 4:
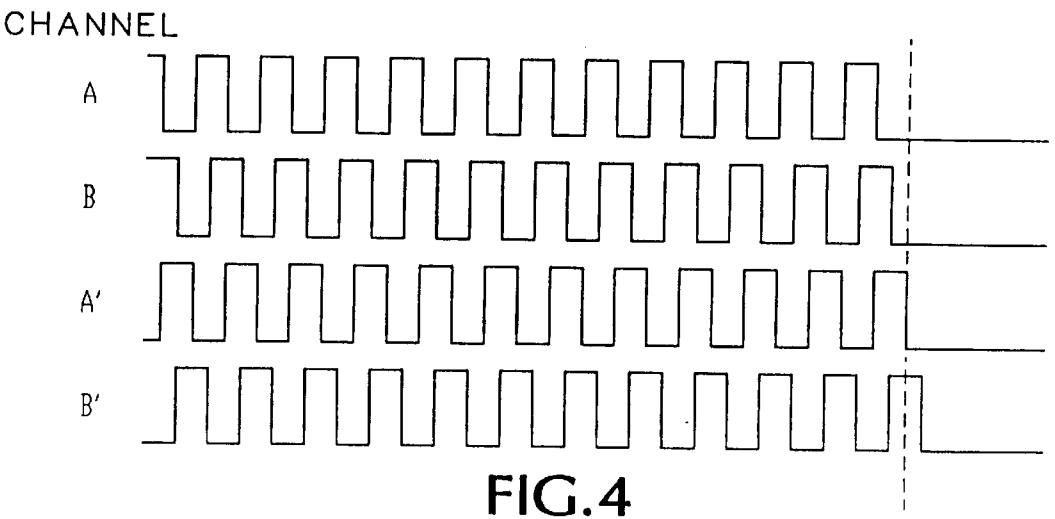
FIG. 4 is a timing diagram illustrating the optical signals sensed by the sensor array as the sensor array moves right-to-left relative to the code strip.

It will be appreciated that encoding pattern 14 may be etched with an array of regular, preferably elongate and rectilinear (hereinafter simply linear) recesses such as recess 14*a* interposed by raised regions such as raised region 14*b*, as illustrated, or alternatively and yet within the spirit and scope of the invention may take the form of through slits formed within the sled, for example, when it is molded. Also within the spirit and scope of the invention, encoding pattern 14 instead may take the form of periodically alternating linear areas of smooth and textured plastic, whether recessed or raised, or the linear features may be printed directly on the surface of the sled or printed on an adhesive label affixable thereto. Finally, encoding pattern 14 may be of a form that is less edge-distinctive, thereby producing a smoother analogue signal such as a sinusoid. Those of skill in the art will appreciate that the digital signal illustrated in FIG. 4 is a conditioned signal output from sensor array 26, as the edge-distinctive pattern 14 typically produces a slightly sinusoidal signal response in array 26. Any and all such encoding patterns and methods of applying them are within the spirit and scope of the invention. It will also be appreciated that, within the spirit and scope of the invention, the output of sensor array 26 may be signal-conditioned, e.g. squared, to produce a binary sequence for digital processing by a controller or it may be unconditioned to produce an analogue signal for analogue processing by a controller.

It will be appreciated that the relative locations of the code strip and the sensor array within the spirit and scope of the invention may be reversed such that the code strip moves with the sled and the sensor array is fixed in the printer's frame. It also will be appreciated that the sensor array may be frame mounted in reading proximity with a code strip that may be formed instead in a rotary mechanism such as a feed roller. Those of skill will appreciate that the pitch or spacing of the alternating bars of the coding pattern is determined by the desired monitoring and/or positioning resolution and thus typically is application-dependent.

Figure 3:
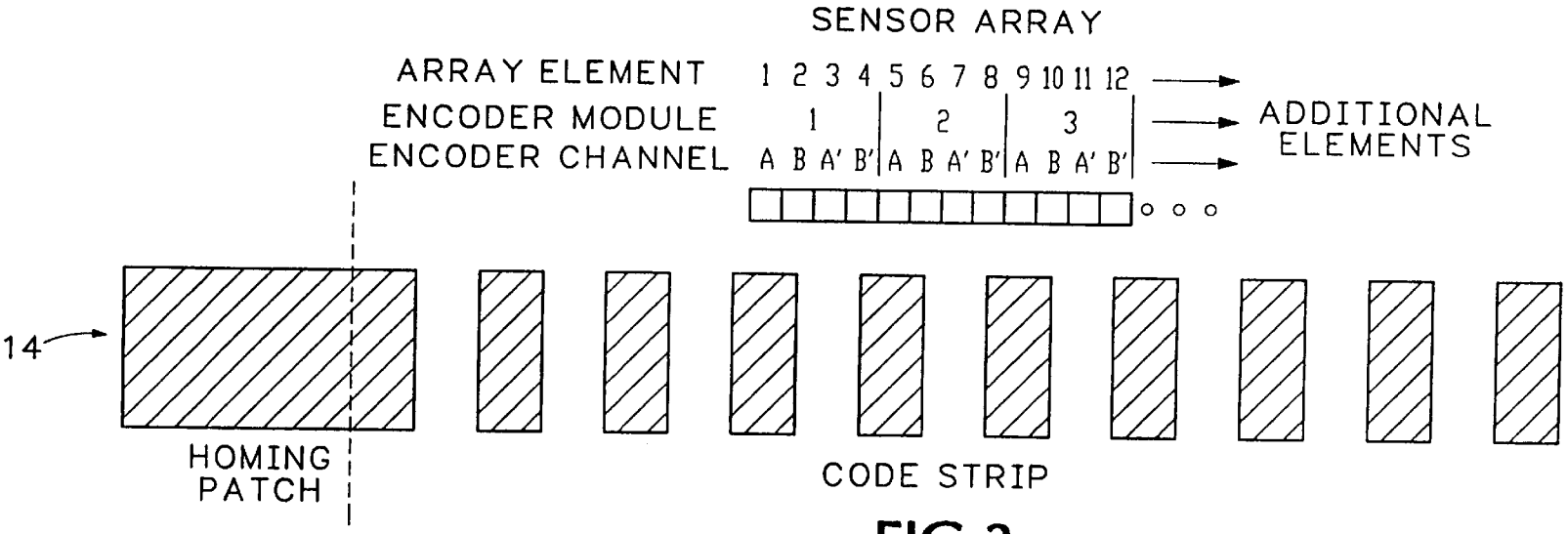
FIG. 3 is a somewhat schematic diagram illustrating the cooperation of the sensor array and the invented code strip or encoding pattern.

Turning now to FIG. 3, the cooperation of code strip 14 and sensor array 26 is illustrated somewhat schematically. Code strip 14 preferably is arrayed longitudinally along the expanse of sled 16 in linear alignment with the reciprocation path produced by motor control. Preferably, code strip 14 includes plural regularly arrayed, alternate areas or regions of optically reflective and non-reflective character. Those of skill will appreciate that the shaded areas of code strip 14 in FIG. 3 represent optically non-reflective areas that will tend to pass, absorb or scatter light incident thereon, whereas the areas between the shaded areas represent optically reflective areas that will tend to reflect light which is incident thereon relatively directly into optical sensor array 26. In other words, the optically reflective areas substantially reflect light incident upon them, while the non-reflective areas insubstantially reflect light incident upon them.

Within the spirit and scope of the invention, encoding pattern 14 need not extend in a plane or straight line within printer subsystem 16. In the case of a continuously or reciprocally rotating mechanism, for example—as contrasted with the illustrated linearly reciprocating mechanism associated with movement along the linear edge region of the planar expanse of sled 16—the encoding pattern might extend circularly around the outer surface of a rotating drum or roller. Such an alternative application of the invention would lend itself to home positioning of, for example, a paper feed roller in an ink-jet or laser printer or a rotating drum-type printing platen in a laser printer.

It will also be appreciated that, if only home positioning is desired, rather than positional tracking also, then the key feature of the coding strip is the homing feature, or so-called homing patch, that, as will be explained by reference to FIGS. 4 and 5, produces signals in response to the optical source that tell the printer's controller when the definitive homing feature is within 'view' of the optical sensor array. As will be seen directly, by the use of plural optical sensors and a homing patch of defined linear dimension relative thereto, useful information may be obtained by the controller other than the mere presence of the homing patch, including the velocity including direction at which the patch is moving relative to the array.

Referring still to FIG. 3, it may be seen that optical sensor array 26 preferably includes numerous discrete, linearly arrayed sensors such as photo-sensitive diodes or transistors. The spacing, or pitch, of the sensors in the array will be understood preferably to be one-fourth the spacing, or pitch, of the alternate bands of light-reflective and light-absorptive features in encoding pattern 14. In other words, four optical elements labeled A, B, A', B' in array 26 are spaced such that they correspond with a single shaded band and its complementary, adjacent space. Such a four-element group will be referred to herein as an encoder module having four channels of information. Ideally, each encoder module would produce four channels of identical information, because of the spacing correspondence between code strip 14 and sensor array 26 and because of the regularity of the pattern along its substantial length. It will be seen that this produces signals the information content of which yields both direction of motion of the sensor array relative to the code strip and also excellent noise immunity and dimensional error tolerance.

Within the spirit and scope of the invention, more or fewer than twelve elements may be used to produce the same or less positional information with a higher or lower confidence level. With as few as one optical element in the sensor, e.g. what may be referred to as a spot sensor, positional information is provided but no directional information is provided (instead it must be assumed), and there is little confidence in the result of interrogating the optical sensor array since its digitized singular output is simply either on or off. In other words, there is no redundant or correlative information available from a simple spot sensor. With as few as two optical elements in the sensor, directional information may be obtained, but there still is a relatively low level of confidence in the positional information obtained.

Accordingly, preferably at least two sensors are used, more preferably at least four sensors are used, and most preferably at least eight sensors are used. In accordance with the preferred embodiment of the invention, twelve or more sensors are used to produce an extremely robust plural-signal decode and a very high level of confidence in the decoded positional and directional information that results from a high correlation between similarly situated sensors' inputs, i.e. all A channels normally should be in agreement as to the reflectivity of the feature within their view, and all A' channels should be logically complementary thereto; all B channels normally should be in agreement as to the reflectivity of the feature within their view, and all B' channels should be logically complementary thereto. Those of skill in the art will appreciate that any suitable correlation techniques may be used by the printer's controller to evaluate the content of the encoding strip at a given point in time, including the use of digital or analogue adders and threshold comparators.

Turning now to FIG. 4, it may be seen that the A, B, A' and B' channels illustrated in FIG. 3 may be described by a timing diagram of the signals received at each of the four-element groups of sensors in array 26 as it moves right-to-left in FIG. 3. Generally speaking, A and A' are complementary, as are B and B', since each of the paired sensors are spaced from one another such that they always sense an opposite reflective characteristic due to the structure and feature-spacing of code strip 14. Because A and B are spaced apart only half of the period of the encoding pattern, they are in a quadrature relationship with one another, as are A' and B'. These quadrature and complementary phase relationships between paired channels may be seen to be characteristic only of the regularly periodic portion of code strip 14. When sensor array 26 passes over the homing patch, the relationships no longer hold, which fact is used to great advantage by the invented apparatus.

Focusing now on the right side of the timing diagrams of FIG. 4, it may be seen that, when A' of a given encoder module goes to a logic zero but A of the given encoder module does not go to logic one, it may be concluded that the homing patch is within 'view' of sensor array 14. This decision point is indicated in FIG. 4 by a vertical dashed line. A corresponding vertical dashed line may be seen in FIG. 3 at a distance into the homing patch equal to the width of the periodic mark or space features of the encoding pattern. Note that the steady state of the four channels of information is that A, B, A' and B' within a given encoder module are all logic zero when the sensor array is 'viewing' the homing patch. So long as the periodic nature of the encoding pattern is maintained—and regardless of whether there is relative movement between code strip 14 and sensor array 26—the all-logic-zero status of the three channels will never be encountered. Accordingly, the homing patch enables the invented apparatus consistently and positively to sense the presence of the homing patch within normally periodic encoding pattern 14.

Figure 5:
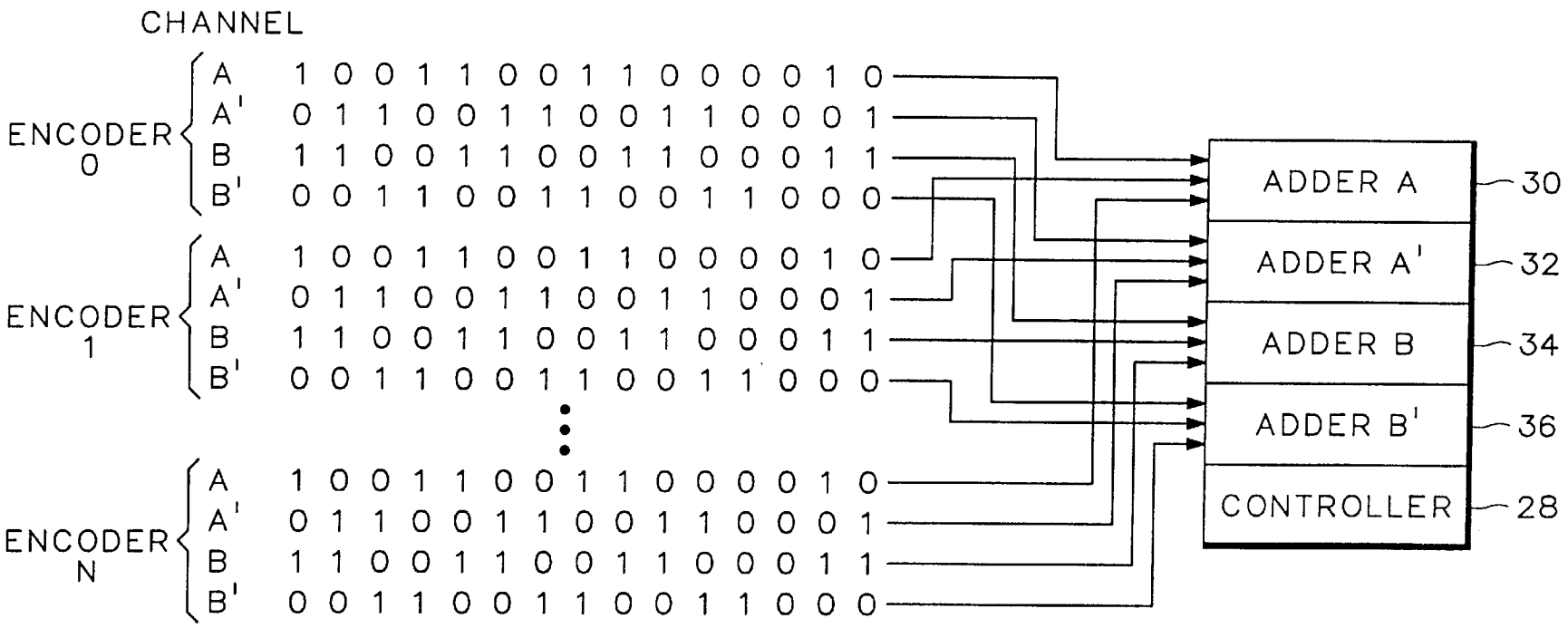
FIG. 5 shows an array of truth tables and adders forming a part of a printer's controller in a schematic diagram showing the binary sequences detected by the controller that indicate the position and velocity of the printer's movable subsystem.

Turning briefly to FIG. 5, it will be appreciated that the illustrated truth tables represent a tabulated version of the timing diagrams of FIG. 4, and that the adders illustrate one method by which the controller may analyze the inputs from the optical sensor array. It may be seen that the homing patch is determined to have been encountered when A=0, A'=1, B=1 and B'=0, but that the printer's control logic preferably defers its decision that the homing patch has been detected until a later time when A=0, A'=0, B=0 and B'=1. This deferred decision-making assures against a false-positive indication that the homing patch has been detected, which false-positive indication might result from environmental contaminants, dimensional or alignment tolerances, spurious sensor array readings, a smeared or worn code strip, etc.

It may be seen from FIG. 5 that, by monitoring preferably four channels of optical information (represented in FIG. 5 as binary 1s and 0s), the printer's controller can determine more than merely positional information. Directional information also is available to the controller because of the quadrature coding of the channel pairs. Moreover, by use of more a sensor array the length of which is greater than the length of the homing patch, the position of the homing patch relative to the sensor array is known by the controller at all instants of time because of what will be referred to herein as edge detection. Controller 14 will be understood to be able to determine when the edge of a homing patch is detected, as illustrated in FIG. 5 with respect to the leading edge thereof indicated by the dashed line. The trailing edge of the homing patch similarly is detectable. But it may be seen that, even when the homing patch is in view of the sensors, by virtue of the fact that its presence may be detected by a single encoder module, other encoder modules within the sensor array simultaneously are viewing regions around the homing patch and remain capable of yielding velocity information, i.e. the movable subsystem's speed and direction, to the printer's controller. Thus, the invented motion-control sensor is extremely versatile compared to prior art spot sensors. This versatility, coupled with the robustness and error-avoidance made possible by redundancy and inter-sensor group data correlation, renders the invented sensor useful in a number of position tracking and control applications.

Those of skill will appreciate that controller herein is used in the broadest possible sense. It may be a part or the same as the microprocessor that typically is a part of every printer's control mechanism, and the controller's functions in implementing the reading and decoding and decision-making steps and mechanisms may be implemented in software or firmware therein. Alternatively, the functions may be hardware-assisted or hardware-implemented, as in a simple majority circuit, a binary adder and associated comparator, a dedicated arithmetic logic unit (ALU), a programmable logic or gate array (PLA), etc., or as in an analogue accumulator such as a sample-and-hold and associated threshold detector circuit (in the case where grey scale or analogue coding, rather than binary coding, is used). Any such implementations or their combination are within the spirit and scope of the invention.

Such controller 28 is illustrated schematically in FIG. 5 as including four adders 30, 32, 34, 36 that, respectively, produce incrementally timed sums representing the four channels A, A', B, B's of binary data. The adder, comparator and decision making functions will be understood preferably to be implemented in firmware, but may be hardware assisted or otherwise implemented. It will be appreciated that illustrated controller 28 preferably may form a part of the printer's controller, which in response to the accumulated sums produced by the adders keeps track of the position and direction of the printer subsystem relative to the code strip, and preferably controls the DC motor. Thus, closed loop control of a less expensive DC motor is made possible.

Summarizing the invention briefly now, the invented apparatus may be thought of as providing for the home-positioning of a movable subsystem relative to a fixed frame of reference within a printer. As is described above, the encoding pattern and sensor array need be mounted in relation to the movable printer subsystem and fixed body of the printer such that the pattern and array are movable relative to one another, thereby to produce the quadrature phase signals. But the invention is not limited to the preferred embodiment in which is illustrated that the pattern is mounted on a fixed frame of reference and the array is mounted on a movable subsystem. It is possible instead to embody the pattern within the movable subsystem and to mount the light source and sensor array on a frame of reference within the printer that is fixed relative to the movable subsystem.

Thus, the apparatus in a broader aspect of the invention may be thought of as including an encoding pattern arrayed along one of a movable subsystem and a fixed frame of reference within a printer, with the pattern including a regular pattern of alternately optically reflective and optically non-reflective stripes such as those shown in the middle region and right end of FIG. 3, and with the pattern further including a distinctive homing patch that is distinguishable from the regular pattern such as the homing patch shown on the left end of FIG. 3; an optical source 24 mounted on the other of the movable subsystem and the fixed frame of reference, with the optical source illuminating the encoding pattern; an optical multiple-sensor array 26 adjacent the optical source and mounted also on the other of the movable subsystem and the fixed frame of reference, with the array detecting luminance modulation resulting from illumination of the encoding pattern by the optical source; and a controller 28 operatively coupled with the array for decoding such detected luminance modulation to sense the presence of the horning patch within the encoding pattern.

Preferably, the encoding pattern and the optical sensor array are configured to produce in the optical sensor array multiple quadrature phase encoded signals for decoding by the controller, as illustrated in FIG. 4 and as described in detail above. Also in accordance with the preferred embodiment of the invention, the encoding pattern and the sensor array are configured to produce redundant data representative of the luminance modulation for correlation by the controller, also as described herein. In further accord with the preferred embodiment of the invention in which it is desired to use a less expensive DC motor to move the movable subsystem relative to the fixed frame of reference, thereby to provide closed-loop positioning control of the subsystem's movement cost effectively, the invented apparatus preferably further includes DC motor 20 operatively connected with controller 28 and responsive thereto to move the movable subsystem, as described and illustrated.

Another way of appreciating the invention is to understand it as apparatus for determining the position of a movable subsystem relative to a fixed subsystem in a printer. By this way of thinking about the invention in which a movable subsystem such as a service station is involved, as in the preferred embodiment described and illustrated herein, the apparatus may be described as including a fixed subsystem-mounted optical source; an encoding pattern arrayed longitudinally along a region of movable subsystem, with the encoding pattern being illuminated by the optical source during movement thereby and with the encoding pattern being configured to produce a first periodically varying optical response to the optical source over its substantial length with reciprocal movement of the movable subsystem, and with the encoding pattern including along a predefined insubstantial extent thereof a homing pattern configured to produce a second substantially invariant optical response defining a home position of the movable subsystem with reciprocal movement thereof; an array of two or more discrete optical sensors mounted on the fixed subsystem adjacent the optical source, with the array of sensors being capable of sensing such first and second optical responses to the optical source; and a controller operatively coupled with the array of sensors for decoding such first and second optical responses to determine the position of the movable subsystem relative to the fixed subsystem based at least in part on detection by the controller of the second optical response.

Again, preferably the encoding pattern is configured to produce in the optical sensors a quadrature phase encoded signal capable of being sensed by the sensor array, such that directional information is obtained. Also preferably the sensor array is configured to produce redundant data for correlation by the controller, as described above regarding the use of plural redundant channels of information and analysis by controller 28 of, for example, sums produced by adders 30, 32, 34, 36 and use by controller 28 of such redundant data to control a DC motor operatively connected therewith for positioning such a movable subsystem.

If the light source and sensor array are mounted on a movable rather than a fixed printer subsystem, then if may be seen that multiple subsystems may be monitored. For example, if the optical source and sensor array are carriage mounted, then when the carriage is over a paper feed roller (having an encoding pattern formed thereon) the feed roller's motion may be monitored and optionally controlled and when the carriage is over a service station sled (having an encoding pattern formed thereon) the service station's motion may be monitored and optionally controlled. Thus, multiple movable subsystems may be home-positioned, position-monitored and optionally position-controlled by the invented apparatus, within the spirit and scope of the invention.

INDUSTRIAL APPLICABILITY

It may be seen then that the invented apparatus has broad applicability to printers and printer subsystems wherein a first movable member and a second fixed member are equipped, irrespectively, with a code strip and an optical source and sensor array, wherein the code strip has a homing patch that accurately may be detected by a controller operatively connected with the optical output of the sensor array. Such may be used particularly for cold starts of printer equipment in which a power loss or paper feed interruption has resulted in a loss of printer subsystem positional information. Moreover, the invented apparatus may be used for velocity tracking and control of the printer subsystem, with greater accuracy and at lower overall cost.

Accordingly, while the present invention has been shown and described with reference to the foregoing preferred device and method for its use, it will be apparent to those skilled in the art the other changes in form and detail may be made therein without departing from the spirit and scope of the invention as defined in the appended claims.

I claim:

1. Apparatus for home-positioning a movable subsystem relative to a fixed frame of reference within a printer, the apparatus comprising:

an encoding pattern arrayed linearly along one of a movable subsystem and a fixed frame of reference within a printer, said pattern including a regular pattern of alternately optically reflective and optically non-reflective stripes, one of said stripes defining a distinctive homing patch that is distinguishable from all remaining stripes;

an optical source mounted on the other of the movable subsystem and the fixed frame of reference, said optical source illuminating said encoding pattern;

an optical multiple-sensor array adjacent said optical source and mounted also on the other of the movable subsystem and the fixed frame of reference, said array detecting luminance modulation resulting from illumination of said encoding pattern by said optical source; and a controller operatively coupled with said array for decoding such detected luminance modulation to sense the presence of said homing patch within said encoding pattern.

2. The apparatus of claim 1, wherein said encoding pattern and said optical sensor array are configured to produce in said optical sensor array multiple quadrature phase encoded signals for decoding by said controller.

3. Apparatus for home-positioning a movable subsystem relative to a fixed frame of reference within a printer, the apparatus comprising:

an encoding pattern arrayed along one of a movable subsystem and a fixed frame of reference within a printer, said pattern including a regular pattern of alternately optically reflective and optically non-reflective stripes, said pattern further including a distinctive homing patch that is distinguishable from said regular pattern;

an optical source mounted on the other of the movable subsystem and the fixed frame of reference, said optical source illuminating said encoding pattern;

an optical multiple-sensor array adjacent said optical source and mounted also on the other of the movable subsystem and the fixed frame of reference, said array detecting luminance modulation resulting from illumination of said encoding pattern by said optical source;

a controller operatively coupled with said array for decoding such detected luminance modulation to sense the presence of said homing patch within said encoding pattern; and said encoding pattern and said sensor array being configured to produce redundant data representative of said luminance modulation for correction by said controller.

4. The apparatus of claim 3 which further comprises a DC motor operatively connected with said controller and responsive thereto to move the movable subsystem.

5. Apparatus for determining the position of a movable subsystem relative to a fixed subsystem in a printer, the apparatus comprising:

a fixed subsystem-mounted optical source;

an encoding pattern arrayed longitudinally along a region of a movable subsystem, said pattern being illuminated by said optical source during movement thereby, said encoding pattern being configured to produce a first periodically varying optical response to said optical source over its substantial length with reciprocal movement of the movable subsystem, said encoding pattern including along a predefined insubstantial extent thereof a homing pattern configured to produce a second substantially invariant optical response defining a home position of the movable subsystem with reciprocal movement thereof;

an array of two or more discrete optical sensors mounted on the fixed subsystem adjacent said optical source, said array of sensors being capable of sensing said first and said second optical responses to said optical source;

a controller operatively coupled with said array of sensors for decoding said first and said second optical responses to determine the position of the movable subsystem relative to the fixed subsystem based at least in part on detection by said controller of said second optical response; and said pattern being configured to produce in said optical sensors a quadrature phase encoded signal capable of being sensed by said sensor array.

6. The apparatus of claim 5 which further comprises a DC motor operatively connected with said controller for positioning such movable subsystem.

7. The apparatus of claim 5, wherein said sensor array is configured to produce redundant data for correlation by said controller.

8. The apparatus of claim 7, wherein said sensor array includes four or more sensors.

9. The apparatus of claim 7, wherein said sensor array includes eight or more sensors.

* * * * *